United States Patent [19]

Kenney

[11] 4,132,622

[45] Jan. 2, 1979

[54] BIPOLAR ELECTRODE

[75] Inventor: Edward J. Kenney, Amherst, N.Y.

[73] Assignee: Hooker Chemicals & Plastics Corp., Niagara Falls, N.Y.

[21] Appl. No.: 856,074

[22] Filed: Nov. 30, 1977

[51] Int. Cl.[2] ..... C25B 11/02; C25B 11/10; C25B 9/00

[52] U.S. Cl. ..... 204/268; 204/270; 204/288; 204/290 F

[58] Field of Search ..... 204/268-270, 204/286, 288, 289, 290 F, 256

[56] References Cited

U.S. PATENT DOCUMENTS

| | | | |
|---|---|---|---|
| 4,013,525 | 3/1977 | Emsley | 204/284 |
| 4,017,375 | 4/1977 | Pohto | 204/268 X |
| 4,055,291 | 10/1977 | Peters | 204/256 X |
| 4,059,216 | 11/1977 | Meyer | 204/256 X |

FOREIGN PATENT DOCUMENTS

| | | | |
|---|---|---|---|
| 1125493 | 8/1968 | United Kingdom | 204/286 |

*Primary Examiner*—John H. Mack
*Assistant Examiner*—D. R. Valentine
*Attorney, Agent, or Firm*—Peter F. Casella; Thomas T. Gordon

[57] ABSTRACT

A hollow bipolar electrode is provided which comprises an anode member and a cathode member. Each member has a base structure and a plurality of removably attached blades or plates extending from the active surfaces of the base structures. The blades or plates are arranged to intermesh when the elctrodes are arranged in a cell. In a preferred embodiment the blades are comprised of a plurality of nested U-shaped sheets.

8 Claims, 3 Drawing Figures

BIPOLAR ELECTRODE

The present invention relates to bipolar electrodes and to their use in bipolar electrolytic cells. In a bipolar electrolytic cell, at least one bipolar electrode is interposed between two monopolar electrodes which, in turn, are connected to a source of direct current. Bipolar cells are particularly useful in processes involving the electrolysis of alkali metal halides to produce alkali metal halates, especially chlorates, such as sodium chlorate, alkali metal perhalates, halites, and hypohalites.

Bipolar electrodes permit electrolytic cells to be compact in construction. Such cells are more economical to fabricate than monopolar cells as the electrodes are connected in series and, therefore, do not require busbars to connect individual cells. Bipolar cells usually operate at lower voltages and at higher production rates per unit floor area, thus resulting in both lower operating costs and initial capital investment.

Typically, a bipolar electrode is comprised of an anode member having an anodically active part electrically connected to a cathode member having a cathodically active part. The members are respectively fabricated from suitable anodic and cathodic materials. The anodically active part, or active face, the portion exposed to the electrolyte, may suitably be fabricated of a valve metal, such as titanium, zirconium, niobium, tungsten and tantalum and their alloys coated with a protective coductive layer formed by previous metals of the platinum group and/or their oxides which may or may not be mixed with other protective oxides. The cathodically active part, or active face, the portion exposed to the electrolyte, is usually fabricated of a metal such as iron or steel which is resistant to both reduction and corrosion by the electrolyte under cathodic conditions.

When bipolar cells are utilized in processes in which hydrogen is evolved on the cathode surface, they are subject to a disadvantage. During the electrolysis of an alkali metal halide in a bipolar cell, for example, nascent hydrogen is formed at the cathode surface. The thus-formed hydrogen permeates through the metal cathode and attacks the titanium or other valve metal on the anode side of the bipolar electrode. In such event, titanium hydride is formed which can be the cause of blistering, embrittlement, flaking, misalignment and stress cracking of the anode member. Hydrogen also permeates through the formed titanium hydride, as titanium hydride does not provide a barrier against hydrogen. This results in a further formation of titanium hydride and further deterioration of the anode. Such deterioration to an extreme can eventually cause the titanium portion of the anode to separate from the iron or steel portion of the electrode, resulting in a complete failure of the electrode.

Deterioration of titanium anodes significantly decreases the useful life of bipolar electrodes, contaminates the products produced by bipolar cells, and increases the cost of operating the cells. Although other materials may be used in place of iron or steel for the cathode portion of the electrode, most metals that are useful are also permeable to hydrogen to some extent. Because of ease of fabrication, availability and conductivity, iron or steel is the most economical and practical material for use as the cathode member.

The present bipolar electrode is substantially resistant to deterioration caused by hydrogen permeation. The anodic and cathodic members of the present electrode are spaced by means of a hollow portion, allowing any hydrogen formed to be vented. The present electrode also provides increased efficiency, ease of adjustment, and simplification of renewal or replacement of electrode components.

DESCRIPTION OF THE PRIOR ART

Hollow bipolar electrodes suitable for use in bipolar electrolytic cells are disclosed in U.S. Pat. No. 3,948,750. A typical bipolar electrode disclosed in this patent consists of an anode structure electrically connected to a cathode structure wherein at least one of the structures is concave with respect to the other in its inner surface forming a hollow between the two structures. The active surfaces of the electrode are planar. U.S. Pat. No. 3,778,362 also describes hollow bipolar electrodes. A typical bipolar electrode disclosed in this patent comprises a hollow steel spacer body having an anode in the form of a flat sheet attached to one side and the cathode in the form of a foraminous sheet attached to the other side. A steel sheet is inserted into and attached to the interior of the steel spacer body towards the anode end to separate a cathode zone from the anode portion of the steel spacer body, thereby forming a hollow cathode chamber.

U.S. Pat. No. 3,759,813 discloses a means of protecting a bipolar electrode by providing a steel backing sheet on which the cathode is mounted, with a protective metal sheet. A space is provided between the protective metal sheet and the steel backing sheet.

Bipolar electrodes and bipolar electrolytic cells are also disclosed in U.S. Pat. Nos. 3,219,563; 3,402,117; 3,441,495; 3,451,914; 3,755,105; and 3,859,197. These patents are cited to illustrate the state of the art.

GENERAL DESCRIPTION OF INVENTION

A hollow bipolar electrode is provided which comprises an anode member and a cathode member, each member having a base structure and a plurality of removeably attached blades or plates extending outward from the active face of the base structures. In a preferred embodiment of the invention, the blades or plates are comprised of a plurality of nested U-shaped sheets which are removeably attached to the active faces of the base structures.

The anode member and the cathode member are in electrically conductive communication with each other and are fabricated from suitable anode and cathode materials respectively. At least one member has a base structure, which is concave in configuration or shape with respect to its inner surface so that a hollow space is formed between the electrode members when the members are assembled to form a bipolar electrode. The hollow electrode is provided with at least one suitable gas vent so that any gases, such as hydrogen, collected in the hollow space may be adequately vented from the electrode. If desired, the inner surfaces of both the anode base structure and the cathode base structure may be concave, or one inner surface may be convex and the other concave as long as the requisite hollow space is formed within the electrode. In a preferred embodiment, one base structure, preferably the anode, is flat or planar with respect to both its inner and outer surfaces, and the other base structure, preferably the cathode, is concave with respect to its inner surface. The outer or active surface is the anode base structure and the cathode base structure are substantially flat or planar.

A plurality of blades or plates in electrical communication with the base structures extend outwardly from the outer or active surface of the base surfaces. The blades or plates are suitably fabricated of materials respectively useful as anodic or cathodic materials. Generally the blades or plates are fabricated of the same material as the respective base structures. The blades or plates are arranged to intermesh, that is, when the electrodes are arranged in a cell, the anode blades and the cathode blades overlap or intermesh with each other, but are not in contact. The active surface area of the electrodes is thus greatly increased, and a corresponding increase in efficiency is also realized. The blades or plates are preferably directly attached to the base structure. In a preferred embodiment of the invention, the blades or plates are removeably attached to the base structures. This arrangement facilitates renewal or replacement of the blade or plate components and allows adjustments to be made in the electrode gap or spacing. Thus the bipolar electrodes of the present invention are adjustable to be adapted to the use of the electrolytic cell. In a preferred form of this embodiment, the blades or plates are formed by a plurality of nested U-shaped sheets and may be removeably attached to the outer surface of the base structures by means of one or more threaded connections extending through the nested portion of the U-shaped sheets. In this arrangement the current distribution to the blades is substantially equalized, being initially distributed along the common contact of the U-shaped sheet and then outward to the individual blades or sheets.

The anode member comprising the anode base structure and the anode blades or plates are preferably fabricated from a non-foraminous valve metal base which has an electrically-conductive, anodically-resistant coating applied to its active surface. Suitable valve metals include titanium, tantalum, niobium and zirconium. A preferred valve metal is titanium. The coating preferably contains one or more platinum-group metals, and/or platinum-group metal oxides. Suitable platinum-group metals include platinum, ruthenium, rhodium, palladium, osmium and iridium. Any of various methods can be used for applying the coating to the valve metal base. Typical methods include precipitation of the metals or metallic oxides by chemical, thermal, or electrolytic processes, ion plating, vapor deposition, or the like means.

The cathode member comprising the cathode base structure and the cathode blades or plates are preferably fabricated from steel, however, chromium, cobalt, copper, iron, lead, molybdenum, nickel, tin, tungsten or alloys thereof can also be used. The cathode, like the anode, is formed from a non-foraminous sheet or plate of metal.

The anode base structure and the cathode base structure are joined in any suitable manner, as by welding, bolting, clamping, riveting or the like, to form the hollow bipolar electrode. The anode base structure and the cathode base structure are in electrically conductive communication with each other, and their respective contacting surfaces are substantially free of any metal oxides or other contaminates that would reduce their electrical conductivity or the electrical conductivity of the electrode.

The electrical conductivity between the anode base structure and the cathode base structure can be improved by applying a coating of a highly conductive metal, such as copper, silver, aluminum, or an alloy thereof, to to the contacting surface of the anode base structure or the cathode base structure or both. Any of various methods can be used for applying the highly conductive metal coating, for example, precipitation of the metals by chemical, thermal or electrolytic means. The electrical conductivity between the base structures can also be improved by inserting strips of a highly conductive metal, such as copper, silver, aluminum or an alloy thereof, between the contacting surfaces.

A typical bipolar electrolytic cell may be assembled by arranging the bipolar electrodes in a row wherein the base structures are positioned parallel to each other and their respective blades or plates are intermeshed but spaced apart from the adjacent electrodes. The base structures are preferably spaced by frame members which may also be utilized to form the top, bottom and sides of the individual cells. Frame members are non-conductors of electricity, are resistant to corrosion by the electrolyte and can withstand the operating temperatures of the electrolytic cell. Examples of suitable materials are various resins such as polypropylene, polybutylene, polytetrafluoroethylene, after chlorinated or rigid FEP, chlorendic acid based polyesters, and the like.

The frame members are provided with suitable entrance and exit ports to allow for circulation of the electrolyte through the bipolar electrolytic cell. Generally, the electrolyte will enter at the bottom of the cell and exit from the top of the cell, although other positions for such ports may also be used. Normally, the electrolyte passes through only one bipolar electrolytic cell unit. Suitable piping arrangements can be made, however, to enable the electrolyte to be circulated through more than one bipolar electrolytic cell unit.

A suitable gasket or sealant material, such as Neoprene, or other chloroprene rubbers, Teflon, or other fluorocarbon resins, or the like, can be placed between each electrode and frame member to provide a gas and liquid tight seal. The individual electrodes and frame members comprising the bipolar electrolytic cell can be joined and held together by any suitable means, such as bolting, clamping, riveting or the like. A particularly preferred means of joining and holding the electrodes and frame members together is a filter press type arrangement wherein pressure means are appplied to the end electrodes or suitable end pressure plates, to hold the entire cell assembly together as an operable unit.

DETAILED DESCRIPTION OF THE INVENTION

The following detailed description of the invention will be accomplished by use of the drawings which are incorporated herein by reference.

Figure 1:
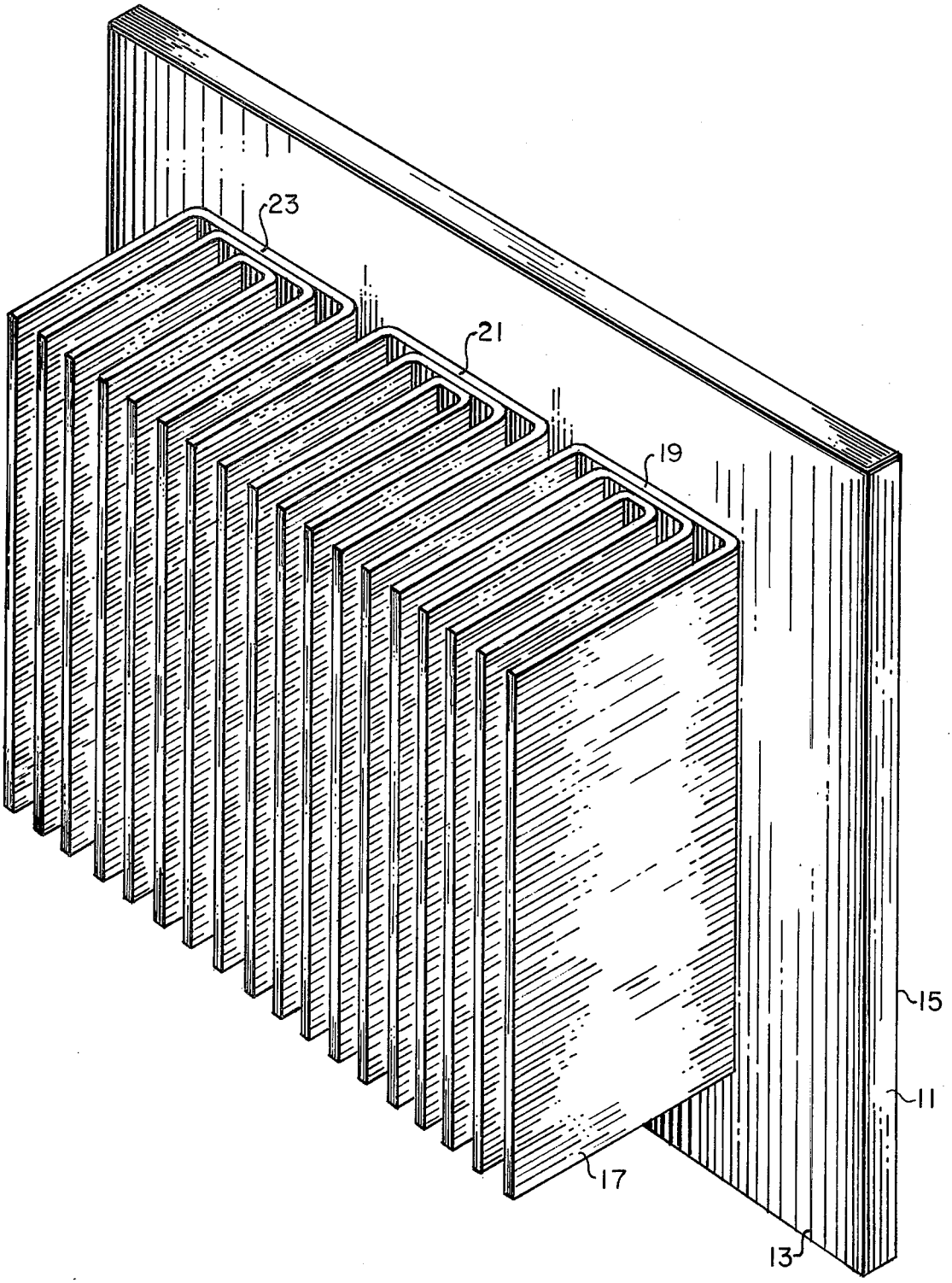
FIGS. 1 and 2 are, respectively, perspective views of a typical anode and cathode structure of the electrode of the present invention.

FIG. 1 shows a preferred anode member for the bipolar electrode of the present invention. The anode member comprises a non-foraminous sheet or plate 11 which also is the anode base structure. The anode member is fabricated of a valve metal. One side of the titanium sheet, the active face 13, is protectively coated with a noble metal of the platinum group and/or an oxide of the platinum group, for example, ruthenium oxide.

The choice of the particular valve metal for the sheet 11 and the particular noble metal or nobel metal oxide for the coating 13 will be governed by the environment in which the electrode structure is to be used. Where the electrode is used in an electrolytic cell for the production of alkali metal halates, such as sodium chlorate, the preferred valve metal for sheet 11 is titanium, and the preferred coating 13 is a mixed coating of ruthenium oxide and titanium oxide, such as that described in U.S. Pat. No. 3,632,498.

The side of sheet 11 that does not contain the activating coating 13, indicated as 15 in the drawing, which is the side to be placed into electrically conductive contact with the cathode member, may have a coating of a highly conductive metal, such as copper, silver, aluminum, or the like along the contact area to enhance the electrically conductive contact between the anode and cathode members of the electrode.

The anode member has a plurality of blades or plates 17 extending from surface 13 of sheet 11 formed by nests of U-shaped sheets 19, 21, and 23. Blades 17 are preferably fabricated of a valve metal such as titanium and are coated in a like manner to anode surface 13.

Figure 2:
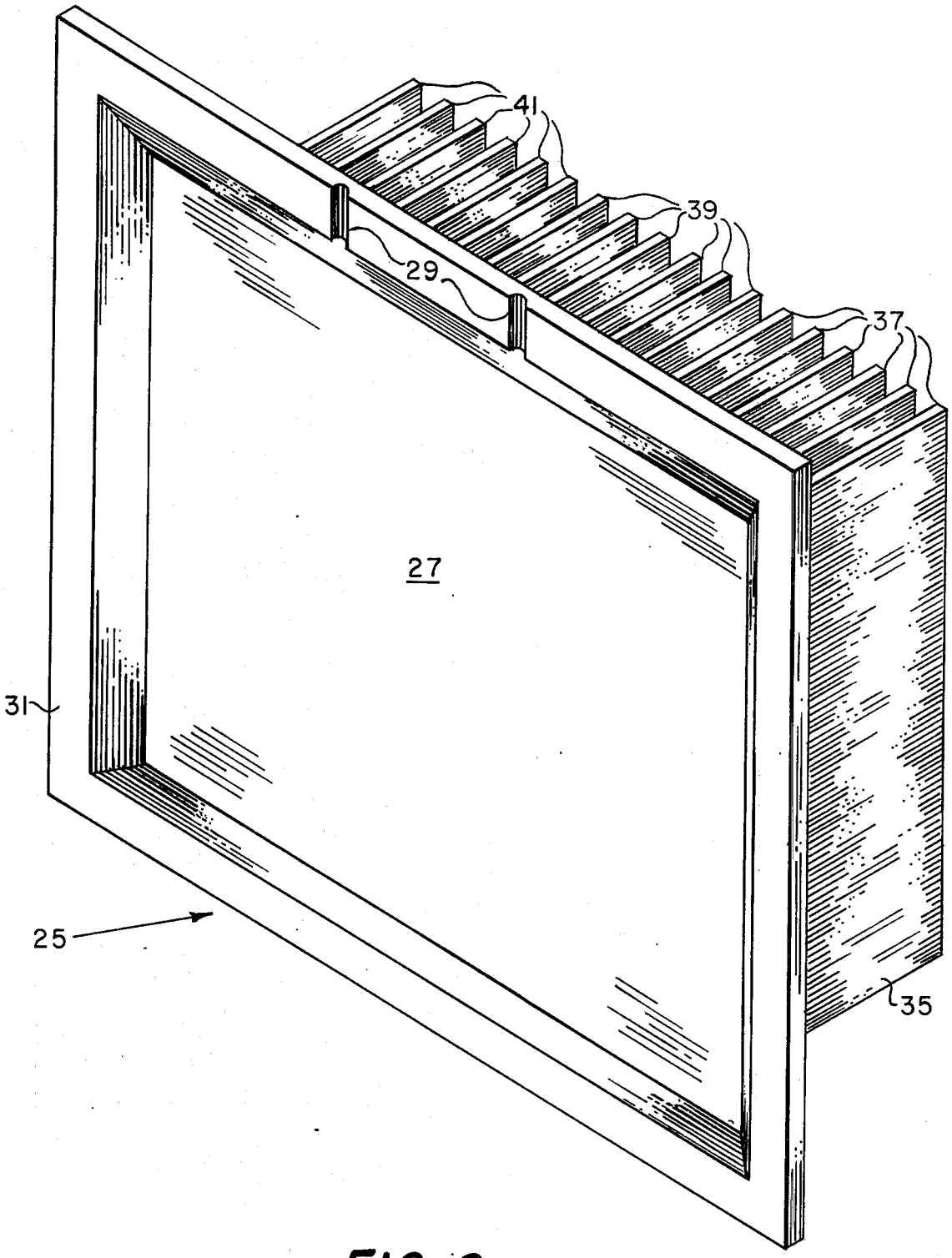

FIG. 2 shows a preferred cathode member 25 which, like the anode, is non-foraminous and fabricated from a suitable metal, such as steel. The cathode 25 is formed with a central, concave portion 27 and gas release vents 29, which provide communication between this central concave portion and the exterior of the cathode, when the anode and cathode components are assembled into the electrode structure. The outer perimeter 31 of the cathode 25, which surrounds the central concave portion 27, is placed in electrically conducting contact with the surface 15 of the anode member 11 when the cathode and anode components are assembled into the electrode of the present invention. This perimeter surface 31, like the surface 15 of the anode, may be provided with a coating of a more highly conductive metal, such as copper, silver, aluminum, or the like, to improve the electrical conductivity between the anode and cathode members. Alternatively, as has been indicated hereinabove, improvement is conductivity may be effected by inserting strips or the like of the more highly conductive metal between the surfaces 31 and 15, rather than coating the surfaces.

Cathode member 25 also includes a plurality of blades or plates 35 attached to the active face thereof. Blades or plates 35 are formed by nests of U-shaped sheets 37, 39 and 41. Blades 35 are preferably fabricated of steel, and, preferably, the entire cathode member 25 is fabricated of steel. Although the preferred material of construction for the cathode member is steel, other metals as have been indicated hereinabove, may also be used, depending upon the particular environment in which the electrode is to be used. It is, however, important that both the anode and cathode be formed of non-foraminous metal sheets or plates rather than from expanded metal, metal mesh or screen, or the like metal structure which contain a multiplicity of foramina or holes.

Figure 3:
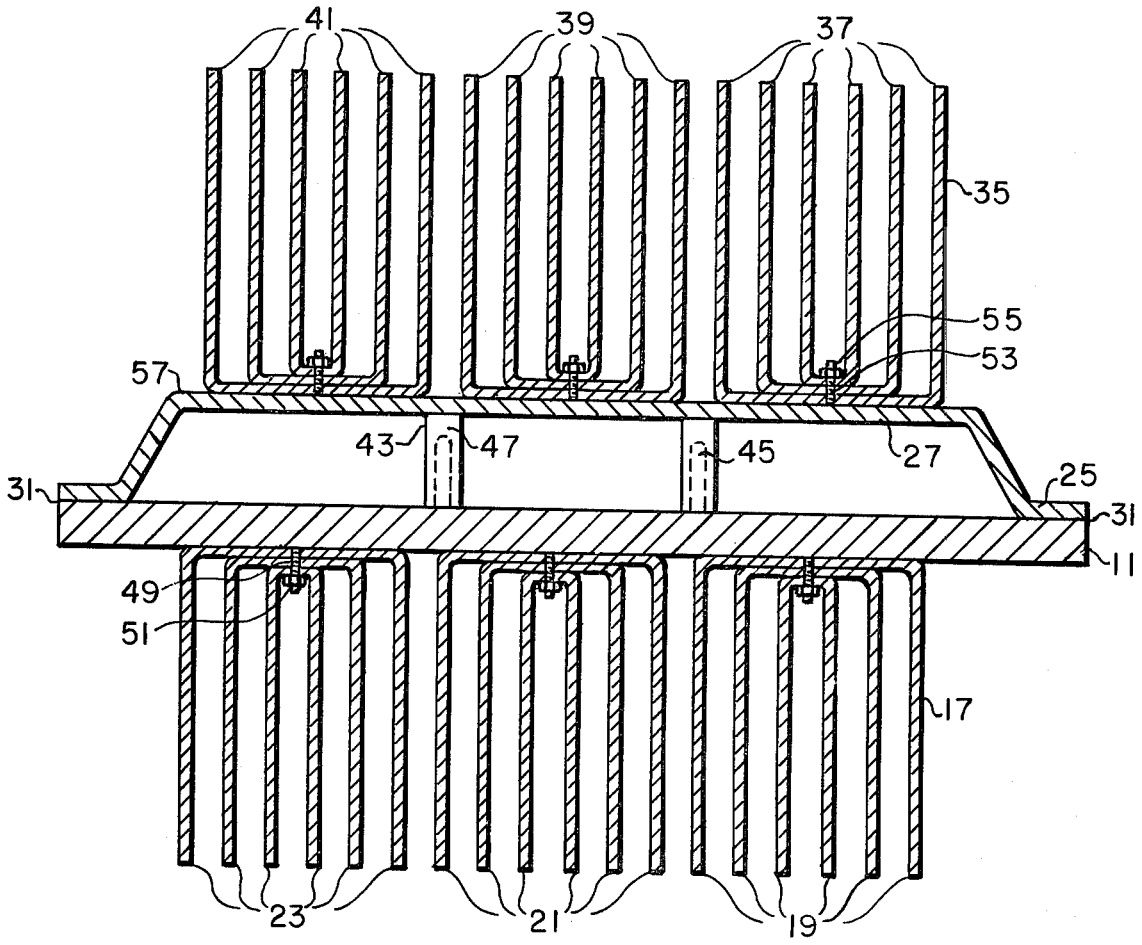
FIG. 3 is a top view, partly in section, of an assembled electrode of the present invention.

Referring now to FIG. 3, this is a top view, partly in section, of an assembled bipolar electrode unit. In this view, anode member 11 is in electrical contact with cathode member 25 along surfaces 31 forming an electrically conductive unit. Concave portion 27 of cathode member 25 forms a hollow space between the anode and the cathode members. Support members 43 may be placed between anode member 11 and cathode member 25 to lend rigidity to the electrode. Preferably, support members 43 are fabricated of a titanium pin 45 welded to the back of anode member 11 and press fit into steel bosses 47 which are welded to cathode member 25. Anode member 11 has a plurality of blades or plates 17 formed by three nests of U-shaped sheets 19, 21 and 23. Although, for ease of illustration, the drawing shows three sets of nested sheets of three U-shaped sheets each, it will be understood that any practical number of nests or sheets may be utilized, depending upon the use and size of the electrode and the desired distribution of current. The nests of U-shaped sheets, 19, 21 and 23, are removeably attached to anode member 11 by means of titanium studs 49 and titanium nuts 51. Blades 17 may thus be removed and replaced as desired thus facilitating changes in anode arrangement, modification of the anode surface area, installation and removal, and adjustments in the spacing of the anode blades. Although the drawing illustrates a threaded stud and nut arrangement for removeably attaching the anode and cathode blades, it will be appreciated that other means may be utilized to removably attach the blades to the anode and cathode face.

Cathode member 25 also has a plurality of blades or plates 35 extending from planar base structure 57 which are formed by nests of U-shaped sheets 37, 39 and 41. Again it will be appreciated that, although three sets of three sheets each are illustrated in the drawing, any practical number of nests or sheets may be utilized. The nests of U-shaped sheets 37, 39 and 41 are removeably attached to cathode member 25 by means of steel studs 53 and steel nuts 55; thus, removal, replacement, rearrangement or adjustment of the cathode blades 35 may be accomplished in a manner similar to that discussed above in respect to the anode blades.

In assembling the electrodes of the present invention into a cell, the anode blades 17 are arranged to intermesh, but not contact, cathode blades 35. Generally, the gap or spacing between the electrodes is adjusted to be as uniform as possible throughout the intermeshed area.

Although the bipolar electrodes of the present invention are particularly suited for use in the production of sodium chlorate, they may also be used in other electrolytic processes as well. Typical of such other processes are the electrolytic production of chlorine and caustic soda; the electrolytic production of persulfates or perborates; the electrolytic oxidation of organic compounds; fuel cells; electrolytic desalination and purification of water; galvanic processes and the like. For such other uses, the materials of construction used for the anode and cathode members of the electrodes will, of course, be selected so as to be suitable in the environment and under the particular conditions that are encountered.

While there have been described various embodiments of the invention, the apparatus described is not intended to be understood as limiting the scope of the invention as it is realized that changes therewith are possible, and it is intended that each element recited in any of the following claims is to be understood as referring to all equivalent elements for accomplishing the same results in substantially the same or equivalent manner, it being intended to cover the invention broadly in whatever form its principle may be utilized.

What is claimed is:

1. A bipolar electrode comprising an anode member and a cathode member, each of said members formed of a non-foraminous metal, each of said members having a base structure and a plurality of blades removeably attached to the active face thereof, said blades positioned to intermesh with each other upon assembly in a cell, said anode and cathode members being joined together in an electrically conductive unit, at least one of said members having a concave portion which when the members are joined together forms a hollowed section in the interior of said electrode, and, at least one gas vent between the interior of said hollow section and the exterior of said electrode, said vent or vents effecting the release of gases from the interior of said hollow section.

2. The electrode of claim 1 wherein said plurality of blades are formed by nested U-shaped sheets.

3. The electrode of claim 1 wherein the plurality of blades are removeably attached by means of a threaded connection.

4. The electrode of claim 1 wherein said anode member is substantially planar in configuration and the cathode member is joined thereto in electrically conductive contact only around its outer periphery, the central portion of said cathode member being concave with respect to said planar anode member.

5. The electrode of claim 4 wherein the anode member is formed of a valve metal and has an electrically conductive, anodically resistant coating on at least a portion of its exterior surface.

6. The electrode of claim 5 wherein the valve metal is selected from titanium, tantalum and niobium and the electrically conductive coating contains at least one material selected from platinum group metals and platinum group oxides.

7. The electrode of claim 1 wherein the cathode member is formed of a metal selected from iron, steel, chromium, cobalt, copper, lead, molybdenum, nickel, tungsten and alloys thereof.

8. The electrode of claim 7 wherein the cathode member is steel.

* * * * *